United States Patent [19]

Kobayashi

[11] 4,401,541

[45] Aug. 30, 1983

[54] APPARATUS FOR ELECTROPLATING A STRIP OF METAL OF RELATIVELY LOW ELECTRIC CONDUCTIVITY

[76] Inventor: Masami Kobayashi, 3-13-15, Hachimanyama, Setagaya-ku, Tokyo, Japan

[21] Appl. No.: 381,751

[22] Filed: May 25, 1982

[30] Foreign Application Priority Data

Nov. 25, 1981 [JP] Japan ..... 56-187788

[51] Int. Cl.[3] ..... C25D 17/00; C25D 17/12

[52] U.S. Cl. ..... 204/206; 204/224 R; 204/DIG. 7

[58] Field of Search ..... 204/224 R, 206, 211, 204/DIG. 7

[56] References Cited

U.S. PATENT DOCUMENTS

| | | | |
|---|---|---|---|
| 3,644,181 | 2/1972 | Donaldson | 204/224 R |
| 3,723,283 | 3/1973 | Johnson | 204/224 R |
| 4,014,773 | 3/1977 | Furuya | 204/206 |

*Primary Examiner*—T. M. Tufariello

*Attorney, Agent, or Firm*—Armstrong, Nikaido, Marmelstein & Kubovcik

[57] ABSTRACT

An apparatus is proposed for electroplating a strip of metal of a relatively low electric conductivity, which can be applied, for example, for a stainless steel strip with gold. Said apparatus comprises anode means, masking device and cathode means, said cathode means comprising a plurality of contact elements which are disposed in said masking device. Thereby, said steel is electroplated on one side partially along its length, in spite of the high electric resistance.

8 Claims, 4 Drawing Figures

APPARATUS FOR ELECTROPLATING A STRIP OF METAL OF RELATIVELY LOW ELECTRIC CONDUCTIVITY

BACKGROUND OF THE INVENTION

The present invention relates to an apparatus for electroplating a strip of metal of a relatively low electric conductivity, for example, a stainless steel with gold.

Many contact elements for electronic devices are conventionally made of Phosphor Bronze or Beryllium Bronze, which are excellent in the electric conducting property. Recently, the need has arisen to use such a contact element for communicating a minimum electric current, which requires such contact elements to provide mechanical resilience as well as electric conductivity. Thus, contact elements of Phospor Bronze or Beryllium Bronze must be formed to be relatively thick.

Stainless steel, as is well known, is excellent in mechanical resilience. Therefore, it is advantageous for contact elements for the above-mentioned use to be made of a relatively thin stainless steel electroplated with gold, since contact elements made of stainless steel may be formed in a small size. Relatively thin stainless steel is obtained from hoop or band steel. However, difficulties arise when stainless steel is gold plated, because the gold must be plated only on portions of the stainless steel and those portions should be as small as possible due to the cost of gold; and wherever the gold is plated, it must be plated at a uniform density. However, it is difficult to plate gold uniformly because stainless steel has a greater electric resistance as compared to copper. Continuous electroplating of stainless steel with gold over a long term has never been accomplished, because of the high electric resistance of stainless steel. If the cathode electrode is connected to the stainless steel outside of the electroplating solution, as in the conventional method, the electric current does not reach the portion of the steel in the solution away from the electrode connecting point, but reaches only the portion near the point where the cathode electrode is connected. If the cathode electrode is connected to the stainless steel within the electroplating solution, gold precipitation concentrates at the connecting points, where the electric voltage is almost completely consumed causing the electric voltage fed to the stainless steel to be reduced.

SUMMARY OF THE INVENTION

It is an object of the invention to provide an apparatus for electroplating a strip of metal of a relatively low electric conductivity, by which said metal is continuously partially electroplated along its longitudinal axis at a uniform density.

The above object is attained by an apparatus for electroplating a strip of metal of a relatively low electric conductivity, said strip being passed continuously through said apparatus and dipped in an electroplating solution so that it is partially electroplated at a predetermined width on one side along its length, said apparatus comprising, according to the invention, anode means being adapted for electrically connecting said solution to a positive pole of an electric source, device for masking said strip from said solution while allowing a part of said strip on said one side to contact said solution corresponding to the width to be electroplated and cathode means being adapted for electrically connecting said strip on the opposite side to a negative pole of the electric source, said cathode means comprising a plurality of contact elements which are disposed in said masking device.

The invention will now be described in detail with reference to the accompanying drawings which illustrate the preferred embodiment of the invention, in which.

DESCRIPTION OF A PREFERRED EMBODIMENT

Figure 1:
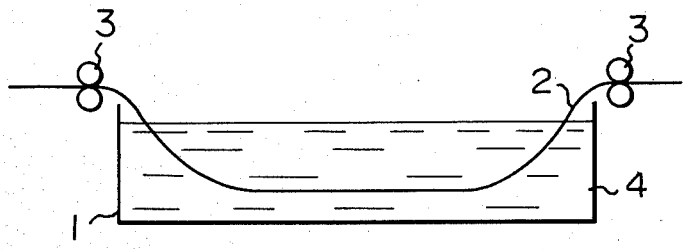
Fig. 1 PRIOR ART
FIG. 1 shows a schematic side view of a conventional apparatus for continuous electroplating.

Referring to FIG. 1, a conventional electroplating apparatus is shown. The numeral 1 designates an electroplating bath container, in which a strip 2 of metal is passed continuously through rollers 3 and dipped in an electroplating solution 4. An anode electrode (not shown) is dipped in the electroplating solution 4, as is well known for those skilled in the art. The rollers 3 are connected electrically to a negative pole, so that the metal in the solution 4 is plated on the surface of the strip 2. However, if the strip 2 is made of a steel of a relatively low electric conductivity, such as stainless steel, the electric current affects only a small portion of the stainless steel strip 2, i.e. the portion near the rollers 3, due to its high electric resistance, and the intermediate portion between the two rollers 3 is not electrically affected. Thus, there is no point in having a long portion of the strip 2 in the electroplating solution.

Figure 3:
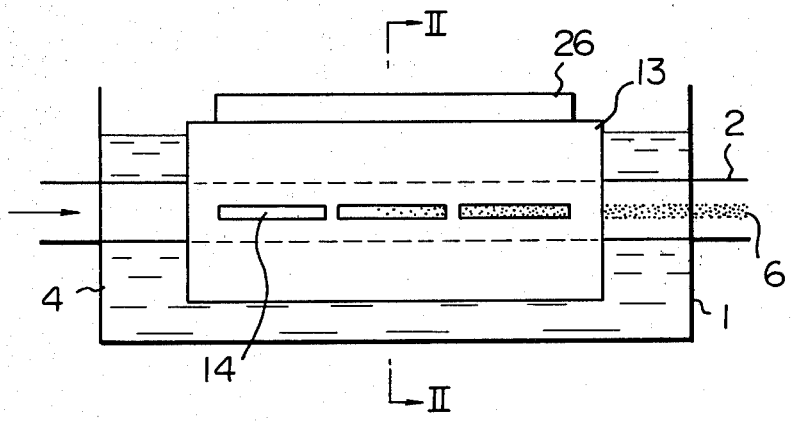
FIG. 3 shows a section of the apparatus taken along the arrow III in FIG. 2.
Figure 2:
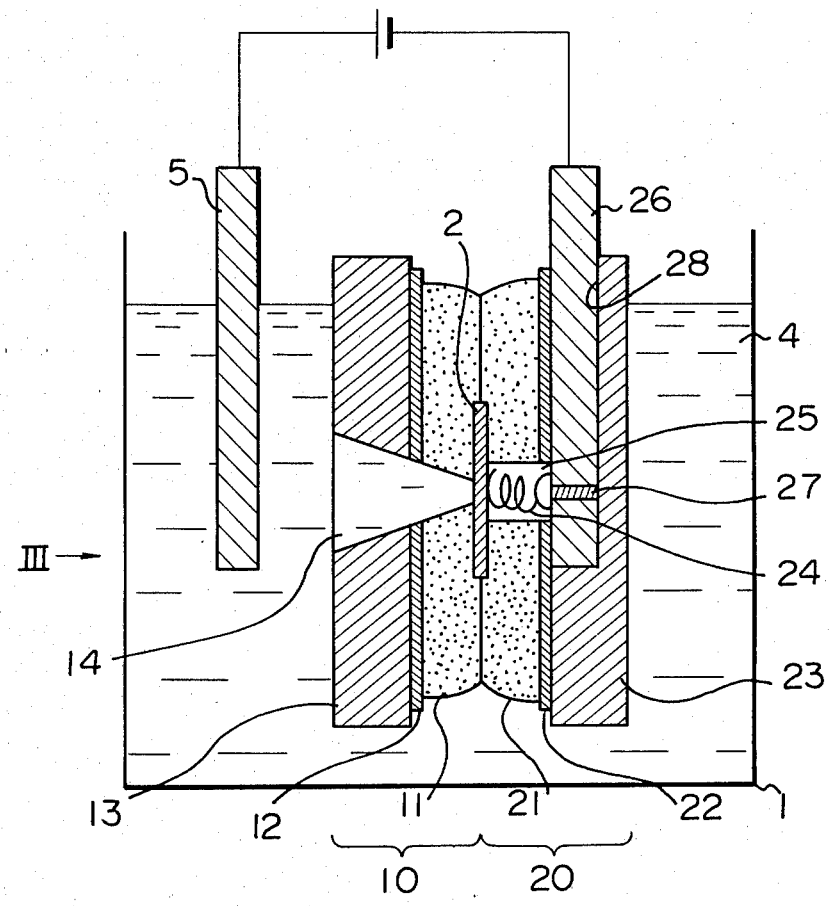
FIG. 2 shows a transverse cross section of an apparatus for electroplating stainless steel with gold, according to the present invention, taken along line II—II in FIG. 3.

Now referring to FIGS. 2 and 3, an apparatus for electroplating a stainless steel with gold is shown. A stainless steel strip 2 is immersed in an electroplating solution 4 and masked by a masking device. The masking device comprises two opposed masking elements 10 and 20, each of which consists of a soft rubber plate 11, 21, a thin plastic plate 12, 22, and a thick plastic plate 13, 23, respectively. The stainless steel strip 2 is passed between the soft rubber plates 11 and 21 along its longitudinal direction, as indicated by the arrow in FIG. 3. Each of the plates of the respective masking elements 10, 20 are bonded to each other, and the two elements 10 and 20 are urged together by a suitable clamping means (not shown), by which the stainless steel strip 2 is shielded from the electroplating solution 4.

In one masking element 10, a slit or a plurality of slits 14 (three slits in this example) are formed through the three plates 11, 12 and 13. The cross section of the slit 14 gets larger toward the electroplating solution 4 and each slit 14 is formed lengthwise in a parallel direction to the strip 2, such that all three slits are in a line. Through these slits, a part of the strip 2 on one side can directly contact the electroplating solution 4, and this contacted portion corresponds to the portion to be partially plated along a longitudinal axis of the strip, as shown by the numeral 6 in FIG. 3.

In the opposed masking element 20, there is provided a cathode means. In this embodiment, the cathode means comprises a plurality of coil springs 24 inserted in respective holes 25 which are formed through the soft rubber plate 21 and the thin plastic plate 22, one of the coil springs 24 being shown in FIG. 2. The coil springs 24 are disposed side by side along the length of the stainless steel strip 2 at positions opposed to the above mentioned slits 14. One end of each of the coil springs 24 contacts the strip 2 on the side which is not the side to be plated. The other end of the each spring 24 is fixed to the copper plate 26 by a screw 27, which copper plate 26 is inserted in a cavity 8 of the thick plastic plate 23, and the upper end of the second masking element 20 projects from the solution 4 so that the copper plate 26 is shielded from the electroplating solution.

The copper plate 26 does not contact the electroplating solution 4 at all and is connected to the positive pole of the direct current source, whereas an insoluble anode, such as a platinum coated titanium plate 5 connected to the positive pole of the same source, is dipped in the electroplating solution 4.

Figure 4:
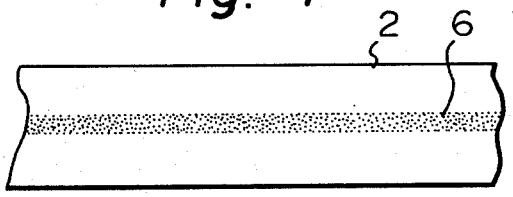
FIG. 4 shows a top view of a strip of stainless steel being plated with gold, according to the invention.

At the beginning of the operation, the stainless steel strip 2 is interposed between the two masking elements 10 and 20 above the electroplating solution, so that no solution enters into the holes 25. This assembly is then dipped in the solution 4 with the upper end of the second masking element 20 projecting from the solution 4, so that the copper plate 26 does not contact the solution 4. The stainless steel strip 2 now is moved in the direction, as shown by the arrow, and receives an effective electric voltage through the copper plate 26 and the coil springs 24. In such a manner, a stainless steel strip becomes gold plated, as shown in FIG. 4. During the operation, a small amount of the solution 4 may leak into the holes 25, but it does not reduce the effectiveness of the apparatus of the present invention.

In the above description, the apparatus for electroplating a stainless steel strip is described as a example, but it is apparent that the present invention can be applied to any other metal which has a low electric conductivity, whereby it is difficult to obtain a uniform plating by a conventional apparatus.

I claim:

1. An apparatus for electroplating a strip of metal of a relatively low electric conductivity, said strip being passed continuously through said apparatus and dipped in an electroplating solution so that it is partially electroplated at a predetermined width on one side along its length, said apparatus comprising:

anode means being adapted for electrically connecting said solution to a positive pole of an electric source;

means for masking said strip from said solution while allowing a part of said strip on said one side to contact said solution corresponding to the width to be electroplated;

and cathode means adapted to electrically connect said strip to a negative pole of the electric source, said cathode means comprising a plurality of contact elements which are disposed inside said masking means, each of said contact elements being arranged to contact said strip on the side which is not to be electroplated at positions opposite those where said solution contacts said strip and being connected to the electric source.

2. An apparatus according to claim 1, wherein said masking means comprises first and second masking elements between which said strip is passed, said first element having a slit or a plurality of slits to allow said strip to contact said solution, said second element having holes to accommodate said contact elements, the upper end of said second element projecting from the top surface of said solution.

3. An apparatus according to claim 2, wherein said slit or slits extend parallel to the axis of said strip with the width corresponding to that to be electroplated.

4. An apparatus according to claim 2, wherein each of said elements is formed with a plurality of layers.

5. An apparatus according to claim 4, wherein said layers are formed with an inner soft material, an intermediate thin plastic material and an outer plastic material.

6. An apparatus according to claim 5, wherein said three layers are bonded to each other.

7. An apparatus according to claim 2, wherein said contact elements are urged to said strip on said opposite side resiliently.

8. An apparatus according to claim 7, wherein said contact elements comprise coil springs inserted in said holes which are arranged side by side along a path of said strip, and said coil springs are fixedly connected to a common plate of a high electric conductivity which is inserted in a cavity formed in said second element, such that said common plate may not touch said solution, with said common plate being connected to said negative pole.

* * * * *